US006551551B1

(12) United States Patent
Gegel et al.

(10) Patent No.: US 6,551,551 B1
(45) Date of Patent: Apr. 22, 2003

(54) SINTER BONDING USING A BONDING AGENT

(75) Inventors: Gerald Albert Gegel, Morton, IL (US); Eric Allen Ott, Cincinnati, OH (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/987,942

(22) Filed: Nov. 16, 2001

(51) Int. Cl.[7] ..... B22F 7/02
(52) U.S. Cl. ..... 419/5; 419/9; 228/194
(58) Field of Search ..... 419/5, 8, 9; 228/194

(56) References Cited

U.S. PATENT DOCUMENTS

| | | | | |
|---|---|---|---|---|
| 3,672,882 A | | 6/1972 | Sagmuller et al. | |
| 3,716,347 A | | 2/1973 | Bergstrom et al. | 29/182.2 |
| 3,717,442 A | | 2/1973 | Knopp | 29/182.2 |
| 3,899,820 A | | 8/1975 | Read et al. | |
| 4,029,476 A | | 6/1977 | Knopp | 428/676 |
| 4,503,009 A | * | 3/1985 | Asaka | 419/6 |
| 4,582,536 A | | 4/1986 | Raybould | |
| 4,614,296 A | | 9/1986 | Lesgourgues | 228/194 |
| 4,676,843 A | | 6/1987 | Nazmy | 148/11.5 N |
| 4,689,077 A | | 8/1987 | Chevigne et al. | |
| 4,710,235 A | | 12/1987 | Scruggs | 148/4 |
| 4,721,598 A | | 1/1988 | Lee | |
| 4,731,115 A | | 3/1988 | Abkowitz et al. | |
| 4,952,199 A | | 8/1990 | Saka et al. | |
| 5,059,387 A | | 10/1991 | Brasel | |
| 5,163,499 A | | 11/1992 | Newkirk et al. | |
| 5,288,357 A | | 2/1994 | Yamada et al. | 156/249 |
| 5,314,658 A | | 5/1994 | Meendering et al. | |
| 5,393,484 A | | 2/1995 | Seyama et al. | 419/37 |
| 5,487,865 A | | 1/1996 | Hampton et al. | 419/5 |
| 5,554,338 A | | 9/1996 | Sugihara et al. | |
| 5,759,707 A | | 6/1998 | Belt et al. | 428/552 |
| 5,788,142 A | | 8/1998 | Bigay et al. | 228/198 |
| 5,812,925 A | | 9/1998 | Ecer | 428/548 |
| 5,837,066 A | | 11/1998 | Linzell | |
| 6,033,788 A | | 3/2000 | Cawley et al. | 428/548 |
| 6,090,320 A | | 7/2000 | Grundner et al. | |
| 6,110,420 A | | 8/2000 | Moorhead et al. | |

* cited by examiner

*Primary Examiner*—Daniel J. Jenkins
(74) *Attorney, Agent, or Firm*—Finnegan, Henderson, Farabow, Garrett & Dunner, L.L.P.

(57) ABSTRACT

A method for joining powder metallurgy components, in particular, those made by metal injection molding is provided. The method includes providing a first and a second powder metallurgy compact each having a bonding surface and a bonding agent including a binder and fine particles. The bonding agent is placed between the bonding surfaces of the first and second powder metallurgy compacts. The first and second powder metallurgy compacts are then consolidated during a sintering cycle in which the first and second powder metallurgy compacts are joined by at least solid state diffusion of the fine particles.

10 Claims, 2 Drawing Sheets

SINTER BONDING USING A BONDING AGENT

TECHNICAL FIELD

The invention relates generally to joining processes and, more particularly, to methods for joining powder metallurgy components during sintering.

BACKGROUND

Powder metallurgy ("P/M") fabrication methods are becoming increasingly more widespread as an alternative to other metalworking technologies. In particular, metal injection molding ("MIM") is a P/M fabrication method that allows net-shape or near-net shape production of components close to full density. Similar to injection molding of thermoplastic polymers, MIM can produce components with complex shapes that would otherwise require extensive machining.

The method typically involves forming a mixture of MIM powders with a binder and injecting the mixture into a mold. Once the green part is ejected from the mold, the binder is removed by a solvent and/or a thermal process. The resulting brown part is then consolidated by sintering.

While MIM can advantageously be used to make components having complex shapes, the process has been generally limited to components having sizes between about 1 and 200 grams. MIM components are usually not joined to each other to form assemblies because conventional joining methods often result in poor bond strength. Sinter bonding, for example, as disclosed in U.S. Pat. No. 5,554,338 is a method for joining P/M components by diffusion bonding. In this method, two compacts in the green or brown state are joined during the sintering process by forming metallurgical diffusion bonds between the P/M components. Diffusion bonds, however, form only at local contact points. Because the brown or green parts have rough bonding surfaces, diffusion bonding at only local contact points may result in poor bond strength.

MIM components can also be joined by conventional sinter brazing methods. Bonds resulting from sinter brazing, however, are generally between 5,000 to 10,000 microns in thickness because of excessive infiltration of filler material into the pores of the P/M components to be joined. Since the filler metal has a different composition compared to the joined P/M components, excessive infiltration not only affects the mechanical properties of the assembly, but results in poor bond strength.

Thus, there is a need to overcome these and other problems of the prior art and to provide methods for forming assemblies by bonding P/M components. The present invention, as illustrated in the following description, is directed to solving one or more of the problems set forth above.

SUMMARY OF THE INVENTION

In accordance with an embodiment of the present invention, a joining method is disclosed. The method includes providing a first and a second powder metallurgy compact each having a bonding surface and a bonding agent including a binder and fine particles. The bonding agent is placed between the bonding surfaces of the first and second powder metallurgy compacts. The first and second powder metallurgy compacts are then consolidated during a sintering cycle in which the first and second powder metallurgy compacts are joined by at least solid state diffusion of the fine particles.

In accordance with another embodiment of the present invention, another joining method is disclosed. The method includes providing a first and a second powder metallurgy compact, wherein the powder metallurgy compacts have similar composition and are formed by metal injection molding. Each powder metallurgy compact has a bonding surface. A bonding agent including a water-based binder and fine particles is placed between the bonding surfaces of the first and second powder metallurgy compacts. The first and second powder metallurgy compacts are consolidated during a sintering cycle in which the first and second powder metallurgy compacts are joined by forming a bond having an essentially similar composition to the first and second powder metallurgy compacts.

In accordance with another embodiment of the present invention, an assembly is disclosed. The assembly include a first powder metallurgy component, at least a second powder metallurgy component, and a bonded joint between the first powder metallurgy component and the at least a second powder metallurgy component formed by solid state diffusion and effectuated by a binding agent including fine particles.

DETAILED DESCRIPTION

In the following description, reference is made to the accompanying drawings that form a part thereof, and in which is shown by way of illustration a specific exemplary embodiment in which the invention may be practiced. This embodiment is described in sufficient detail to enable those skilled in the art to practice the invention and it is to be understood that other embodiments may be utilized and that changes may be made without departing from the scope of the present invention. The following description is, therefore, not to be taken in a limited sense.

Figure 1:
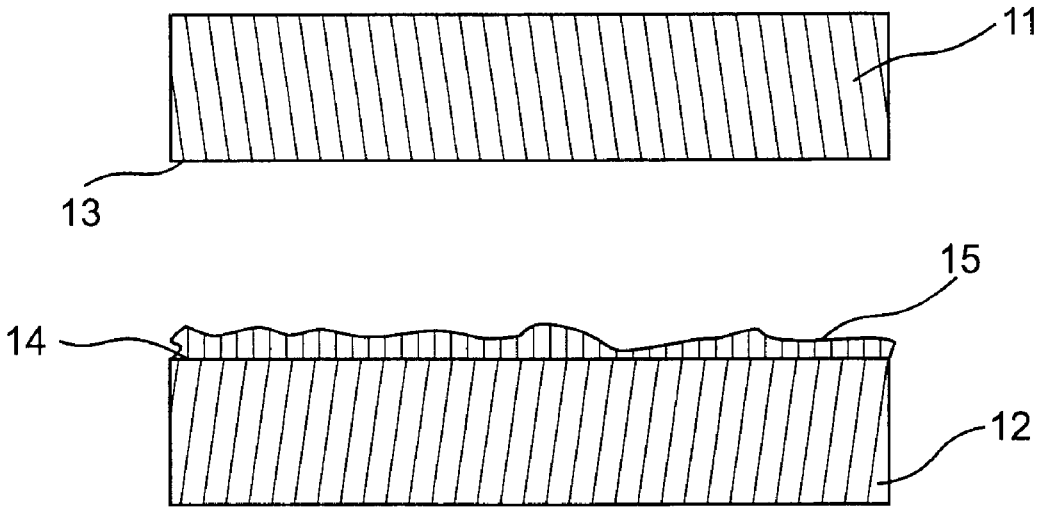
FIG. 1 is a diagrammatic cross-section of a first and a second powder metallurgy compact and a bonding agent consistent with an exemplary embodiment of the invention.
Figure 2:
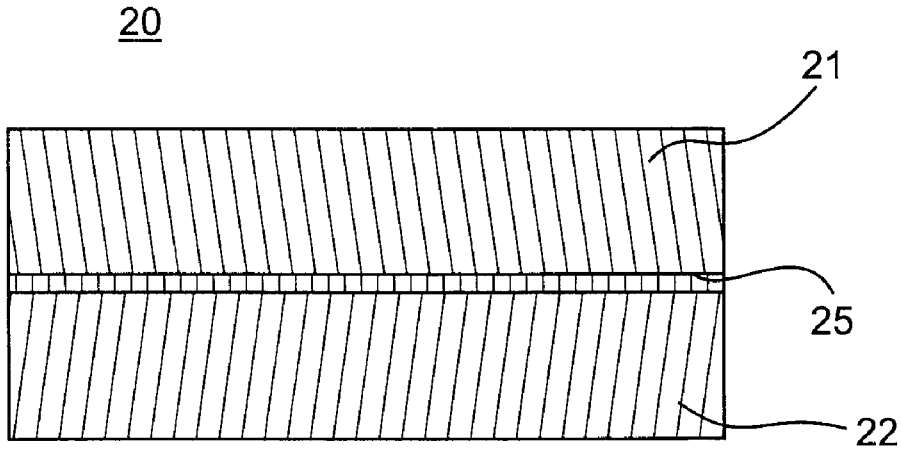
FIG. 2 is a diagrammatic cross-section of an assembly consistent with an exemplary embodiment of the invention.

With reference to FIGS. 1 and 2, a method for joining P/M components in accordance with an exemplary embodiment of the present invention is disclosed. FIG. 1 shows first P/M compact 11 having bonding surface 13 and second P/M compact 12 having bonding surface 14. As used herein, the terms "P/M compact" and "powder metallurgy compact" are interchangeable and, unless otherwise distinguished, mean a shaped powder in the brown and/or green state. First P/M compact 11 and second P/M compact 12 can be formed by processes known by those with skill in the art and include, but are not limited to, metal injection molding, mechanical compacting, binder-assisted extrusion, warm compaction, isostatic pressing, spray forming, and slip casting.

In one exemplary embodiment of the method of the present invention, first P/M compact 11 and second P/M compact 12 have similar compositions as a result of being formed from similar P/M powders and similar binders. In another embodiment of the method of the present invention, first P/M compact 11 and second P/M compact 12 have dissimilar compositions as a result of being formed from dissimilar P/M powders and/or dissimilar binders.

Bonding agent 15 is placed between bonding surface 13 of first P/M compact 11 and bonding surface 14 of second P/M compact 12. Bonding agent 15 is a mixture of a binder and fine particles that are compatible with the composition (s) of the P/M compacts. The binder can be wax-based or water-based and acts to hold the fine particles together prior to debinding or sintering. Suitable binders and debinding processes are known to those with skill in the art. Fine particles are those having a diameter of about 10 microns or less. While the composition of the P/M compacts to be joined dictates the type of fine particles, the fine particles are generally characterized by high surface energy and high diffusivity into the base metals of first P/M compact 11 and second P/M compact 12. These characteristics effectuate formation of a diffusion bond between P/M compacts 11 and 12 during sintering. For example, fine particles of at least one of Fe, Ni, and Cu have high diffusivity to effectuate bonding most P/M compacts of austenitic precipitation hardenable ("PH") stainless steel.

The fine particles of bonding agent 15 promote complete local bonding by providing local contact where the surface roughness of bonding surfaces 13 and 14 do not locally contact each other and hold P/M compacts 11 and 12 together prior to bonding. Thus, the viscosity of bonding agent 15 can vary from about 1350 centipoise to about 250,000 centipoise, but should be high enough so that an effective amount can be placed, and remain, between bonding surface 13 of first P/M compact 11 and bonding surface 14 of second P/M compact 12. An effective amount of bonding agent 15 is an amount that results in a sufficiently strong diffusion bonded joint between P/M compacts 11 and 12.

An assembly, including first P/M compact 11, second P/M compact 12, and bonding agent 15 between bonding surfaces 13 and 14, is then formed and sintered. During sintering, atoms of the fine particles constituting the bonding agent and atoms of the powders constituting the P/M compacts are transported via solid state diffusion across the interfaces between the P/M compacts and the bonding agent. Sintering cycle parameters such as the cycle times, cycle temperatures, and type of atmosphere depend on a number of factors, such as, for example, the constituents of the base materials being consolidated, and are known to those skilled in the art.

FIG. 2 shows a sintered assembly, generally designated by reference numeral 20, including first P/M component 21 resulting from consolidation of first P/M compact 11 and second P/M component 22 resulting from consolidation of second P/M compact 12. First P/M component 21 is joined to second P/M component 22 by bond 25.

Bond 25 is formed by at least solid state diffusion of the fine particles into first P/M compact 11 and second P/M compact 12 during the sintering cycle. Bonding may also result from solid state diffusion of materials from first P/M compact 11 and second P/M compact 12 into each other. Although some liquid phase of the fine particles may be formed during sintering and result in some fusion bonding, the primary bonding mechanism is a solid state process. In other words, bonding is due primarily to solid state diffusion rather than by fusion. In the case where P/M components 21 and 22 have the same composition, the composition of bond 25 is essentially similar to that of the P/M components 21 and 22 since it is formed by solid state diffusion. Thus, the concentration gradient across a cross section of the bond 25 and the bonding surfaces, if it exists, is minimized. Where the compositions of P/M components 21 and 22 differ, bond 25 will have a composition gradient from component 21 to component 22. Localized areas having a different composition, such as, for example, a localized area having a concentration essentially that of the fine particles can exist, but do not substantially affect the strength of bond 25.

Figure 3:
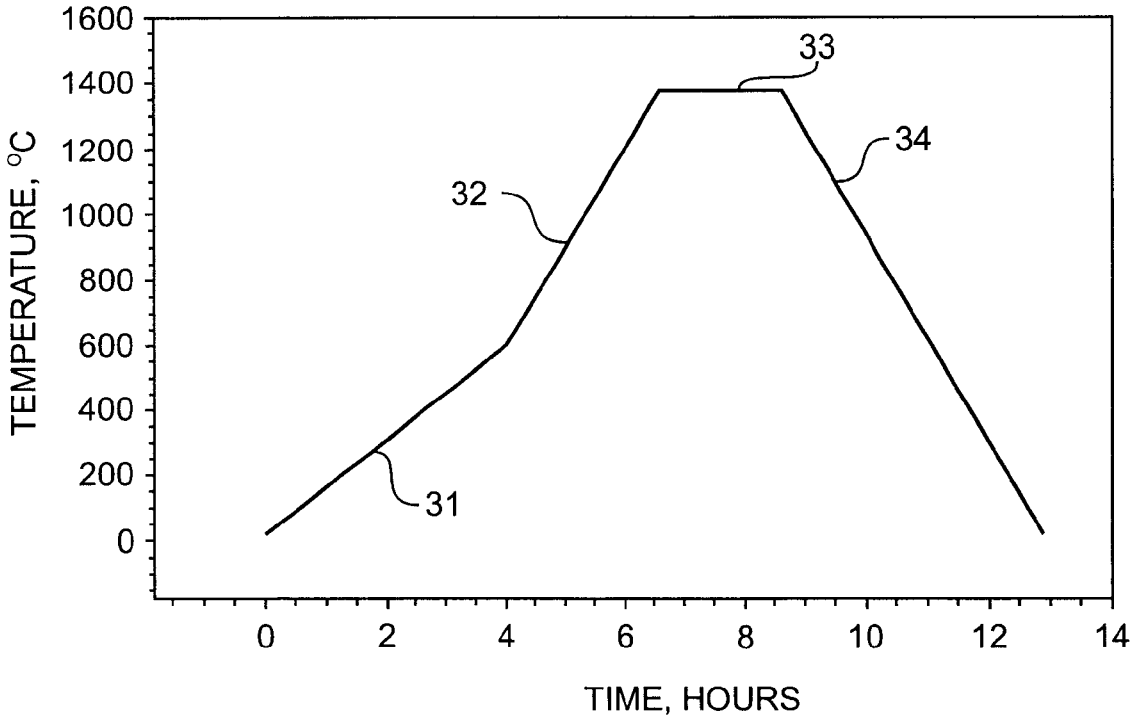
FIG. 3 is a diagrammatic representation of a sintering cycle consistent with an exemplary embodiment of the invention.

FIG. 3 shows an example of a method of joining in accordance with an exemplary embodiment of the present invention. FIG. 3 depicts a sintering cycle directly incorporating a debinding cycle to join two cylindrical P/M compacts formed by metal injection molding. The two P/M compacts were formed from a mixture including 17–4 PH stainless steel base powder and a methyl cellulose based binder. The mixture was injection molded to form two green compacts having a cylindrical shape. A bonding surface was formed on each of the cylindrical P/M compacts by belt grinding a portion of each of the cylinders flat. The bonding agent was a mixture of carbonyl iron powder having a diameter of about 2–4 microns, methyl cellulose, and water. The bonding agent had a viscosity of about 1350 centipoise. In another exemplary embodiment of the present invention, the bonding agent had a viscosity of about 255,000 centipoise. An assembly was formed by placing the bonding agent between the bonding surfaces of the two P/M compacts.

The assembly was then placed into a batch furnace and subject to thermal debind cycle 31, shown in FIG. 3, in a hydrogen atmosphere. The flow rate of the hydrogen was sufficient for about 20–40 volume changes per hour. The purpose of thermal debinding cycle 31 was to form a brown P/M compact by removing the methyl cellulose binder from the two green P/M compacts and from the bonding agent. Then, during pre-sintering heating cycle 32, the furnace temperature was raised to the sintering temperature and a hydrogen atmosphere was provided with a flow rate sufficient for about 20–40 volume changes per hour. The temperature was raised during cycle 32 at a rate sufficient to avoid significant melting of the fine particles. Once at the sintering temperature, the assembly was held at sintering cycle 33 to consolidate the brown P/M compacts and to complete formation of a diffusion bond between them. Subsequently, in post-sinter cycle 34, the furnace was powered down to room temperature using the same atmosphere and flow rate as the previous cycles to avoid oxide formation. The furnace was then back filled with nitrogen and the sintered assembly removed.

Industrial Applicability

The methods and assemblies according to the present invention provide the capability of joining P/M components to one another. Although the methods have wide application to join most components formed by P/M methods, the present invention is particularly applicable to joining two or more metal injection molded P/M components. Metal injection molding allows production of components having complex shapes that could not economically be made by other metal working techniques, but is limited to production of relatively small sized components. The present invention provides a method for making parts too large or too complex in shape to be metal injection molded to be made by joining two or more smaller metal injection molded P/M components. The method accomplishes this by use of a bonding agent that avoids localized bonding problems associated with conventional sinter bonding methods and excessive filler metal infiltration problems associated with conventional sinter brazing methods.

It will be readily apparent to those skilled in this art that various changes and modifications of an obvious nature may be made, and all such changes and modifications are considered to fall within the scope of the appended claims.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A joining method comprising:

providing a first and a second powder metallurgy compact, wherein each powder metallurgy compact has a bonding surface;

providing a bonding agent including a binder and fine particles;

placing the bonding agent between the bonding surfaces of the first and second powder metallurgy compacts;

consolidating the first and second powder metallurgy compacts during a sintering cycle; and joining the first and second powder metallurgy compacts during the sintering cycle by at least solid state diffusion of the fine particles.

2. The method of claim 1, wherein at least one of the first and second powder metallurgy compacts is formed by metal injection molding.

3. The method of claim 1, wherein the first and second powder metal compacts have similar compositions and the fine particles are selected to minimize a composition gradient across a cross section of the bonding surfaces after sintering.

4. The method of claim 1, wherein the first and second powder metal compacts have dissimilar compositions and the fine particles effectuate formation of a composition gradient across the bonding surfaces after sintering.

5. The method of claim 1, wherein the binder is at least one of wax-based or water-based.

6. A joining method comprising:

providing a first and a second powder metallurgy compact, wherein each powder metallurgy compact has a similar composition and is formed by metal injection molding, and wherein each compact has a bonding surface;

providing a bonding agent including a water-based binder and fine particles;

placing the bonding agent between the bonding surfaces of the first and second powder metallurgy compacts;

consolidating the first and second powder metallurgy compacts during a sintering cycle; and joining the first and second powder metallurgy compacts during the sintering cycle by forming a bond having an essentially similar composition to the first and second powder metallurgy compacts.

7. The method of claim 6, further including debinding at least one of the first and second powder metal compacts prior to consolidating the first and second powder metallurgy compacts.

8. The method of claim,6, wherein the first and second powder metallurgy compacts include 17-4 ph stainless steel powder as a base metal.

9. The method of claim 6, wherein the binder is methyl cellulose.

10. The method of claim 8, wherein the fine particles include at least one of Fe, Ni, and Cu fine particles.

* * * * *

UNITED STATES PATENT AND TRADEMARK OFFICE

CERTIFICATE OF CORRECTION

PATENT NO. : 6,551,551 B1
DATED : April 22, 2003
INVENTOR(S) : Gerald A. Gegel et al.

It is certified that error appears in the above-identified patent and that said Letters Patent is hereby corrected as shown below:

Title page,
Item [56], References Cited, U.S. PATENT DOCUMENTS, insert the following:
-- 3,716,347 2,717,442 4,029,476 4,614,296 4,710,235
5,288,357 5,393,484 5,487,865 5,759,707 5,788,142
5,812,925 6,033,788 --
Item [57], ABSTRACT,
Line 5, insert -- the fine particles including elemental constituents -- after "particles"
Line 11, insert -- of the elemental constituents -- after "diffusion"

Column 5,
Line 14, insert paragraph -- the fine particles including elemental constituents -- after "particles;"
Line 22, insert -- of the elemental constituents -- before "of"

Column 6,
Line 27, delete "ph" and insert -- PH --

Signed and Sealed this

Nineteenth Day of August, 2003

JAMES E. ROGAN
*Director of the United States Patent and Trademark Office*